US005131981A

United States Patent [19]

Hahn et al.

[11] Patent Number: 5,131,981

[45] Date of Patent: Jul. 21, 1992

[54] COLORING PAPER

[75] Inventors: Erwin Hahn, Heidelberg; Georg Henning, Ludwigshafen; Manfred Mielke, Heidelberg; Hans-Juergen Degen, Lorsch; Sigberg Pfohl, Speyer, all of Fed. Rep. of Germany

[73] Assignee: BASF Aktiengesellschaft, Ludwigshafen, Fed. Rep. of Germany

[21] Appl. No.: 711,378

[22] Filed: Jun. 6, 1991

Related U.S. Application Data

[63] Continuation of Ser. No. 251,840, Sep. 30, 1988, abandoned.

[30] Foreign Application Priority Data

Sep. 30, 1987 [DE] Fed. Rep. of Germany ..... 3732981

[51] Int. Cl.[5] ..... D21H 21/28; D21H 17/45; D21H 17/50; D21H 23/10

[52] U.S. Cl. ..... 162/162; 162/168.4; 162/168.5; 162/168.3; 162/168.2; 162/183

[58] Field of Search ..... 162/168.2, 168.3, 162, 162/183, 168.4, 168.5; 106/498

[56] References Cited

U.S. PATENT DOCUMENTS

| | | | |
|---|---|---|---|
| 2,730,446 | 1/1956 | Hutchins | 162/162 |
| 2,838,397 | 6/1958 | Gruntfest | 162/168.2 |
| 2,926,116 | 2/1960 | Keim . | |
| 3,016,325 | 1/1962 | Pattilloch | 162/162 |
| 3,021,257 | 2/1962 | Stauffenberg | 162/168.2 |
| 3,049,468 | 8/1962 | Hinton | 162/162 |
| 3,128,222 | 4/1964 | Herschler | 162/162 |
| 3,860,583 | 1/1975 | Schmitt | 162/162 |
| 4,174,998 | 11/1979 | Shiel | 162/168.3 |
| 4,314,001 | 2/1982 | Wesseler | 162/162 |
| 4,348,257 | 9/1982 | Maslanka | 162/168.2 |
| 4,370,443 | 1/1983 | Wesseler | 162/164.1 |
| 4,383,834 | 5/1983 | Degen et al. . | |
| 4,444,959 | 4/1984 | Frey et al. . | |
| 4,469,555 | 9/1984 | Maslanka | 162/168.2 |
| 4,711,727 | 12/1987 | Matthews | 162/168.2 |

FOREIGN PATENT DOCUMENTS

| | | |
|---|---|---|
| 0061173 | 9/1982 | European Pat. Off. . |
| 0146000 | 6/1985 | European Pat. Off. . |
| 3111713 | 10/1982 | Fed. Rep. of Germany . |
| 1509967 | 5/1978 | United Kingdom . |

OTHER PUBLICATIONS

Bayer Farben Revue, Special Issue Apr. 2, 1984, pp. 79–82.

Ratgeber fur die Verwendung von BASF-Erzeug--nissen in der Papierindustrie, Aug. 1972, pp. 4–13, 22–23.

Ullmanns Encyklopädie der Technischen Chemie, 4th Edition, vol. 17, pp. 577–578, 613–614, 634–635.

*Primary Examiner*—Stanley S. Silverman
*Assistant Examiner*—Thomas M. Lithgow
*Attorney, Agent, or Firm*—Oblon, Spivak, McClelland, Maier & Neustadt

[57] ABSTRACT

The wet-end coloring of paper with pigments and fixers is carried out by a process in which the pigment and fixer are added simultaneously to the paper pulp to be colored, and the fixer used is a cationic fixer, in an amount of from 0.01 to 3% by weight, based on the dry paper pulp to be colored.

7 Claims, No Drawings

COLORING PAPER

This application is a continuation of application Ser. No. 07/251,840, filed on Sep. 30, 1988, now abandoned.

The present invention relates to a novel process for the wet-end coloring of paper with pigments and fixers, wherein the pigment and fixer are added simultaneously to the paper pulp to be colored, and the fixer used is a cationic fixer, in an amount of from 0.01 to 3% by weight, based on the dry paper pulp to be colored.

Paper is usually colored using dyes (cf. for example Ullmans Encyklopädie der technischen Chemie, 4th Edition, Volume 17, pages 613 and 614). However, the paper colored in this manner generally has inadequate fastness properties, in particular excessively low light-fastness.

The coloring of paper with pigments is likewise known (Ullman, loc. cit.), but the pigments generally have no affinity for the fibers of the paper and possess only poor coloring power. In wet-end coloring, the problem of two-sidedness also arises.

In Ratgeber für die Verwendung von BASF-Erzeugnissen in der Papierindustrie, 8/72, page 22, it is suggested that pigments be used together with fixers. Fixers mentioned in this context include those based on polyimines. It is expressly pointed out that it is important first to add the fixer to the paper stock and then to add the pigment.

Bayer Farben Revue, special issue 4/2, 1984, pages 79–82, discloses that laminated paper can be colored by means of pigments and cationic wet-strength agents. In this case too, the order of addition of the components is very important. Thus, one third of the amount of cationic wet-strength agent should first be added to the pulp, then the colored pigment and finally the remaining two-thirds of the amount of cationic wet-strength agent.

However, we have found that, in the wet-end coloring of paper by the stated methods, the above-mentioned deficiencies cannot be eliminated.

It is an object of the present invention to provide a novel process for the wet-end coloring of paper, in which pigments also are used as colorants and the known disadvantages should no longer occur.

We have found that this object is achieved and that, surprisingly, the wet-end coloring of paper with pigments and fixers can be advantageously carried out if the pigment and fixer are added simultaneously to the paper pulp to be colored, and the fixer used is a cationic fixer selected from the group consisting of A) homopolymers of diallyldimethylammonium chloride and copolymers of diallyldimethylammonium chloride with acrylamide and/or methacrylamide, whose K value is not less than 30, B) homopolymers of vinylimidazoles and copolymers of vinylimidazoles with acrylamide and/or methacrylamide, which may have been reacted with epichlorohydrin, C) homopolymers of vinylimidazoline and copolymers of vinylimidazoline with acrylamide and/or methacrylamide, D) copolymers which contain copolymerized vinylamine units, E) copolymers of acrylamide with ($C_1$–$C_4$-dialkylamino-$C_1$–$C_4$-alkyl acrylates and/or methacrylates, F) polyethyleneimines and polyamidoamines and G) condensates of formaldehyde, dicyanodiamide and, if required, urea, in an amount of from 0.01 to 3% by weight, based on the dry paper pulp to be colored.

Suitable pigments which may be used in the novel process are both inorganic and organic pigments, organic pigments being preferably used.

Inorganic pigments which serve as colorants in the novel process are, for example, iron oxides, iron cyanoferrates, sulfur-containing sodium aluminum silicates, titanium dioxides and carbon blacks.

Organic pigments which serve as colorants in the novel process are, for example, those from the class consisting of the monoazo pigments (e.g. products which are derived from acetoacetic arylide derivatives or from β-naphthol derivatives), laked monoazo dyes (e.g. laked β-hydroxynaphthoic acid dyes), diazo pigments, condensed diazo pigments, isoindoline derivatives, derivatives of naphthalenetetracarboxylic or perylenetetracarboxylic acid, anthraquinone pigments, thioindigo derivatives, azomethine derivatives, quinacridones, dioxazines, pyrazoloquinazolones, phthalocyanine pigments or laked basic dyes (e.g. laked triarylmethane dyes).

Examples are the inorganic pigments Pigment Yellow 42 (C.I. 77,492), Pigment White 6 (C.I. 77,891), Pigment Blue 27 (C.I. 77,510), Pigment Blue 29 (C.I. 77,007), and Pigment Black 7 (C.I. 77,266) and the organic pigments Pigment Yellow 1 (C.I. 11,680), Pigment Yellow 3 (C.I. 11,710), Pigment Yellow 42 (C.I. 77,492), Pigment Yellow 74 (C.I. 11,741), Pigment Yellow 83 (C.I. 21,108), Pigment Yellow 106, Pigment Yellow 108 (C.I. 68,240), Pigment Yellow 117, Pigment Yellow 126, Pigment Yellow 139, Pigment Yellow 185, Pigment Orange 5 (C.I. 12,075), Pigment Orange 67, Pigment Red 3 (C.I. 12,120), Pigment Red 48:1 (C.I.. 15,865 : 1), Pigment Red 48:4 (15,865:4), Pigment Red 101 (C.I. 77,491), Pigment Red 112 (C.I. 12,370), Pigment Red 123 (C.I. 71,145), Pigment Red 169 (C.I. 45,160:2), Pigment Violet 23 (C.I. 51,319), Pigment Violet 27 (C.I. 42,555:3), Pigment Blue 1 (C.I. 42,595:2), Pigment Blue 15:1 (C.I. 74,160), Pigment Blue 15:3 (C.I. 74,160), Pigment Blue 61 (C.I. 42,765:1), Pigment Green 7 (C.I. 74,260) and Pigment Green 36 (C.I. 74,265).

Cationic fixers of the abovementioned class (A) are conventional homopolymers of diallyldimethylammonium chloride and copolymers of diallyldimethylammonium chloride with acrylamide and/or methacrylamide. The copolymerization can be carried out using any desired monomer ratio. The K value of the homopolymers and copolymers of diallyldimethylammonium chloride is not less than 30, preferably from 95 to 180.

Cationic fixers of the abovementioned class (B) are conventional homopolymers of vinylimidazole of the formula I

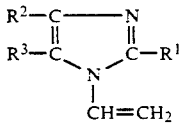

(I)

where $R^1$, $R^2$ and $R^3$ are identical or different and independently of one another are each hydrogen or methyl and $R^1$ may furthermore be $C_2$–$C_4$-alkyl, and water-soluble copolymers of a) not less than 10% by weight of a vinylimidazole of the formula I, b) up to 90% by weight of acrylamide and/or methacrylamide and, if required, c) up to 30% by weight of acrylonitrile, methacrylonitrile, vinyl acetate, vinlypyrrolidone, and ethylenically unsaturated $C_3$–$C_5$-carboxylic acid or its esters, and the homopolymers and copolymers may have been reacted with epichlorohydrin in a ratio of from 0.02 to 2.0 moles of epichlorohydrin per mole of basic nitrogen.

Cationic fixers of class (B) are described in, for example, EP-A-146 000.

Cationic fixers of the abovementioned class (C) are conventional homopolymers of vinylimidazoline of the formula II

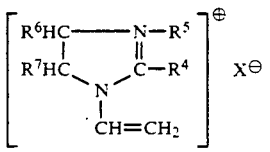

(II)

where $R^4$ is hydrogen, $C_1$–$C_{18}$-alkyl or a radical

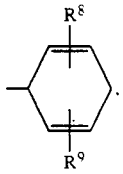

where $R^8$ and $R^9$ are identical or different and independently of one another are each hydrogen, $C_1$–$C_4$-alkyl or chlorine, $R^5$ is hydrogen, $C_1$–$C_{18}$-alkyl, benzyl or

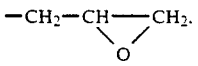

$R^6$ and $R^7$ are identical or different and independently of one another are each hydrogen or $C_1$–$C_4$-alkyl and $X^{\oplus}$ is an anion, preferably chloride, bromide, sulfate, methosulfate, ethosulfate or carboxylate, and water-soluble copolymers which contain, as copolymerized units, a) not less than 1% by weight of a compound of the formula II and b) acrylamide and/or methacrylamide, the K value of the homopolymers and copolymers being from 50 to 250.

Cationic fixers of the class (C) are described in, for example, DE-A-3 613 651.

Cationic fixers of the abovementioned class (D) are conventional copolymers which contain copolymerized vinylamine units which are obtained by copolymerization of a) from 95 to 10 mol % of N-vinylformamide with b) from 5 to 90 mol % of an ethylenically unsaturated monomer of the group consisting of vinyl acetate, vinyl propionate, $C_1$–$C_4$-alkyl vinyl ether, N-vinyl pyrrolidone and esters, nitriles and amides of acrylic acid and methacrylic acid and subsequent elimination of from 30 to 100 mol % of the formula groups from the copolymer.

Cationic fixers of the class (D) are described in, for example, EP-A-216 387.

Cationic fixers of the abovementioned class (E) are conventional copolymers of acrylamide and from 90 to 10, preferably from 70 to 30%, by weight of ($C_1$–$C_4$-dialkylamino)-$C_1$–$C_4$-alkyl acrylates and/or methacrylates.

Cationic fixers of the abovementioned class (F)) are conventional polyethyleneimines which are obtained by polymerization of ethyleneimine in aqueous solution in the presence of an acidic catalyst. In 10% strength aqueous solution, they have a pH of 7 and a viscosity of from 5 to 100, preferably from 10 to 40, mPa.s (measured in a rotational viscometer at 20 rpm and 20° C.). The polymers can be neutralized with organic acids, such as formic acid, acetic acid or propionic acid, or with inorganic acids, such as hydrochloric acid, sulfuric acid or phosphoric acid.

Other examples are polyamidoamines which are crosslinked with epichlorohydrin. Suitable products of this type are disclosed in, for example, U.S. Pat. No. 2,926,116. They are prepared by condensing a dicarboxylic acid, such as adipic acid, with a polyamine, e.g. diethylenetriamine or tetraethylenepentamine, and crosslinking the resulting resin with epichlorohydrin to such an extent that the resulting reaction products are still water-soluble. In 10% strength by weight aqueous solution at 20° C., these polymers have a viscosity of from 20 to 200 mPa.s (measured with a rotational viscometer at 20 rpm and 20° C. at a solids content of 10% by weight in water).

This group of cationic polymers includes polyamidoamines which are grafted with ethyleneimine and are crosslinked with epichlorohydrin or, according to DE-A-2 434 816, with reaction products which are obtained by reacting the terminal OH groups of polyalkylene oxides having from 8 to 100 alkylene oxide units (preferably polyethylene oxides) with not less than equivalent amounts of epichlorohydrin. The viscosity of the water-soluble products grafted with ethyleneimine and cross-linked is from 300 to 2,500 mPa.s (measured with a rotational viscometer at 20 rpm and 20° C. at a solids content of 10% by weight in water).

Cationic fixers of the abovementioned class (G) are conventional condensates of formaldehyde, dicyanodiamide and, if required, urea, which have a molar ratio of dicyanodiamide to urea to formaldehyde of from 1:0–3:-2–5.

The abovementioned K value of the polymers was determined in each case according to H. Fikentscher, Cellulosechemie, 13 (1932), 58–64 and 71–74, at 25° C. in a 5% strength by weight aqueous sodium chloride solution and at a polymer concentration of 0.5% by weight; $K = k.10^3$.

According to the invention, the cationic fixers are used in an amount of from 0.01 to 3, preferably from 0.03 to 1, in particular from 0.05 to 0.5%, by weight, in each case based on the dry paper pulp to be colored.

The pigments are generally used in an amount of from 0.01 to 5, preferably from 0.05 to 2, in particular from 0.1 to 2%, by weight, based on the dry paper pulp to be colored.

The novel process is advantageously carried out by a method in which the paper pulp to be colored is initially taken and pigment and cationic fixer are then added. According to the invention, the pigment and cationic assistant are added simultaneously to the paper pulp. There are several possible methods of addition: - addition of pigment and fixer at different points in space, - addition of pigment and fixer together, the two components being mixed differently before addition (for example in the conveying apparatus) or - addition of a prepared mixture (preparation) which contains both pigment and cationic fixer.

In a preferred procedure, the pigment and fixer are added together to the paper pulp. The addition of a prepared pigment/fixer mixture is particularly preferred. Such a preparation can contain not only pigment and fixer but also further assistants, for example fungicides, water-retention agents or surfactants, for example nonionic surfactants, such as adducts of alkylene oxides with fatty acids, alcohols, phenols, amides, mercaptans, amines or alkylphenols (cf. K. Lindner, Tenside-Textilhilfsmittel-Waschrohstoffe, Volume 1, pages 837-917, 1964).

The cationic fixers are generally used in the form of an aqueous solution.

The pigments used as colorants in the novel process are advantageously employed in the form of conventional pigment preparations, for example as aqueous dispersions. Preferred aqueous pigment preparations are those which contain nonionic surfactants as dispersants. Examples of nonionic surfactants are the abovementioned components.

For example, unbleached or bleached pulps, groundwood or waste paper, each with or without fillers, such as kaolin, chalk or talc, or further assistants, such as aluminum sulfate or resin size, can be used as paper pulps to be colored. The pH of the stock suspension can be from 4 to 9. Preferably used paper grades are those which are prepared at neutral pH, for example tissue or art papers.

The novel process gives homogeneous colorations which have only slight two-sidedness. They also possess good lightfastness and fastness to bleeding.

Another advantage is that bleachable papers are obtained when organic pigments from the class consisting of the monoazo pigments based on $\beta$-naphthol, e.g. Pigment Orange 5 (C.I. 12075), the isoindoline derivatives, e.g. Pigment Yellow 139 or Pigment Yellow 185, or the laked basic dyes, e.g. Pigment Red 48:1 (C.I. 15865:1, Pigment Red 48:4 (C.I. 15865:4), Pigment Blue 1 (C.I. 42595:2) or Pigment Violet 27 (C.I. 42535:3), are used. The bleaches used are the conventional bleaches known in the paper industry, e.g. sodium hypochlorite or sodium dithionite.

The small amount of fixer used is also noteworthy. An increase in the amount of fixer above the amount according to the invention does in fact result in a substantial deterioration in the coloration. Surprisingly, this is in contrast to the coloring of paper with dyes, where the quality of the coloration depends directly on the amount of fixer.

Furthermore, when the novel process is carried out, no foam formation occurs, and only a relatively short action time is required, i.e. the pigments are absorbed rapidly by the paper pulp.

Finally, it should be pointed out that, when the novel process is carried out, a waste water is obtained which is only very slightly colored, if at all.

The Examples which follow illustrate the invention.

Experimental procedure

A paper having a basis weight of 80 g/m$^2$ was produced at a speed of 60 m/min from 80% by weight of bleached spruce sulfite pulp and 20% by weight of bleached beech sulfite pulp on an experimental paper machine having a working width of 75 cm. The pH of the stock suspension was 7.5 and the freeness was 35° SR. Papers were made from this stock suspension under the conditions stated below.

The following cationic fixers were used:

Fixer 1:

Homopolymer of diallyldimethylammonium chloride having a K value of 100, in the form of a 30% strength aqueous solution (viscosity 1,000 mPa.s, 20° C.).

Fixer 2:

Copolymer of 20% by weight of acrylamide and 80% by weight of 2-diethylaminoethyl acrylate, in the form of a 10% strength by weight aqueous solution (viscosity 5,000 mPa.s, 20° C.).

Fixer 3:

Polyamidoamine grafted with ethyleneimine and crosslinked according to DE-A-2 434 816, in the form of a 10% strength by weight aqueous solution (viscosity 500 mPa.s, 20° C.).

Fixer 4:

Copolymer of 80% by weight of acrylamide and 20% by weight of vinylimidazole which has been reacted with epichlorohydrin, in the form of a 10% strength aqueous solution (viscosity 1,000 mPa.s, 20° C.).

The following organic pigments were used:

Pigment 1: Pigment Yellow 185
Pigment 2: Pigment Yellow 1 (C.I. 11680)
Pigment 3: Pigment Red 112 (C.I. 12370)
Pigment 4: Pigment Blue 15 (C.I. 74160)
Pigment 5: Pigment Orange 5 (C.I. 12075)
Pigment 6: Pigment Black 7 (C.I. 77266)

The components were added in the following ways:

I (Comparison)

Addition of the untreated pigment to the regulating box of the paper machine.

II (Comparison)

Separate addition of the cationic fixer to the head box and of the untreated pigment to the regulating box, i.e. addition of the fixer first followed by the addition of the pigment.

III (According to the invention)

Preparation of an aqueous dispersion by adding the cationic fixer to an aqueous pigment suspension and adding this cationic dispersion to the regulating box.

The percentages stated below are each percentages by weight. The percentages relating to pigment and fixer are based on each case on the dry pulp.

EXAMPLE 1

| Version of addition | Depth of color [%] (Version III = 100%) | Waste-water | Two-sidedness top side (Wire side = 100) |
|---|---|---|---|
| I (0.5% of pigment 1) | 0 | Very greatly colored | |
| II (0.15% of fixer 1 and 0.5% of pigment 1) | 75 | Colored | 140 |
| III (10% strength dispersion containing 0.15% of fixer 1 and 0.5% of pigment 1) | 100 | Colorless | 125 |

EXAMPLE 2

| Version of addition | Depth of color [%] (Version III = 100%) | Waste-water | Two-sidedness top side (Wire side = 100) |
|---|---|---|---|
| I (0.5% of pigment 2) | 0 | Very greatly colored | — |
| II (0.25% of fixer 2 and 0.5% of pigment 2) | 75 | Colored | 140 |
| III (20% strength dispersion containing 0.25% of fixer 2 and 0.5% of pigment 2) | 100 | Very slightly colored | 125 |

EXAMPLE 3

| Version of addition | Depth of color [%] (Version III = 100%) | Waste-water | Two-sidedness top side (Wire side = 100) |
|---|---|---|---|
| I (0.5% of pigment 3) | 0 | Very greatly colored | — |
| II (0.1% of fixer 3 and 0.5% of pigment 3) | 80 | Colored | 140 |
| III (25% strength dispersion containing 0.1% fixer 3 and 0.5% of pigment 3) | 100 | Colorless | 130 |

EXAMPLE 4

| Version of addition | Depth of color [%] (Version III = 100%) | Waste-water | Two-sidedness top side (Wire side = 100) |
|---|---|---|---|
| I (1% of pigment 4) | 0 | Very greatly colored | — |
| II (0.2% of fixer 1 and 1% of pigment 4) | 85 | Colored | 130 |
| III (40% strength dispersion containing 0.2% of fixer 1 and 1% of pigment 4) | 100 | Colorless | 120 |

EXAMPLE 5

| Version of addition | Depth of color [%] (Version III = 100%) | Waste-water | Two-sidedness top side (Wire side = 100) |
|---|---|---|---|
| I (0.5% of pigment 5) | 0 | Very greatly colored | — |
| II (0.15% of fixer 1 and 0.5% of pigment 5) | 80 | Colored | 170 |
| III (10% strength dispersion containing 0.15% of fixer 1 and 0.5% of pigment 5) | 100 | Colorless | 150 |

EXAMPLE 6

| Version of addition | Depth of color [%] (Version III = 100%) | Waste-water | Two-sidedness top side (Wire side = 100) |
|---|---|---|---|
| I (1% of pigment 6) | 0 | Very greatly colored | — |
| II (0.2% of fixer 1 and 1% of pigment 6) | 70 | Colored | 150 |
| III (40% strength dispersion containing 0.2% of fixer 1 and 1% of pigment 6) | 100 | Colorless | 120 |

We claim:

1. A process for the wet-end coloring of paper with pigments and fixers, wherein the pigment and fixer are added simultaneously to the paper pulp to be colored, the pigment is an isoindoline derivative, and the fixer used is cationic fixer selected from the group consisting of homopolymers of diallyldimethylammonium chloride and copolymers of diallyldimethylammonium chloride with acrylamide and/or methacrylamide, whose K value is not less than 30, in an amount of from 0.01 to 3% by weight, based on the dry paper pulp to be colored, and the pigment being used in amount of 0.01 to 5% by weight of the dry paper pulp to be colored.

2. A process as claimed in claim 1, wherein a preparation containing pigment and cationic fixer is added.

3. The process of claim 2 wherein the pigment is used in an amount of 0.01 to 2% by weight of the dry paper pulp to be colored.

4. A process for the wet-end coloring of paper with pigments and fixers, wherein the pigment and fixer are added simultaneously to the paper pulp to be colored, the pigment is an inorganic or organic pigment selected from the group consisting of an inorganic pigment of the group consisting of iron oxides, iron cyanoferrates and an organic pigment selected from the group consisting of diazo pigments, condensed diazo pigments, isoindoline derivatives, derivatives of naphthalenetetracarboxylic, derivatives of perylenetetracarboxylic acid, thioindigo derivatives, azomethine derivatives, quinacridones, dioxazines, and pyrazoloquinazolones, and the fixer used is cationic fixer selected from the group consisting of homopolymers of diallyldimethylammonium chloride and copolymers of diallyldimethylammonium chloride with acrylamide and/or methacrylamide, whose K value is not less than 30, in an amount of from 0.01 to 3% by weight, based on the dry paper pulp to be colored, and the pigment being used in amount of 0.01 to 5% by weight of the dry paper pulp to be colored.

5. The process of claim 4 wherein the pigment is used in an amount of 0.01 to 2% by weight of the dry paper pulp to be colored.

6. The process of claim 5, wherein the pigment is an organic pigment selected from the group consisting of diazo pigments, condensed diazo pigments, isoindoline derivatives, derivatives of naphthalenetetracarboxylic, derivatives of perylenetetracarboxylic acid, thioindigo derivatives, azomethine derivatives, quinacridones, dioxazines, and pyrazoloquinazolones, 7. The process of claim 5, wherein the pigment is an inorganic pigment selected from the group consisting of iron oxides and iron cyanoferrates.

* * * * *